United States Patent [19]

Hashimoto

[11] 4,154,280

[45] May 15, 1979

[54] FOLDING OR UNDRAWING MEANS FOR ACCORDION CURTAIN

[76] Inventor: Tadakatsu Hashimoto, c/o Yokota, Inc., 5-7-2, Ueno, Taitou-ku, Tokyo, Japan

[21] Appl. No.: 846,426

[22] Filed: Oct. 28, 1977

[30] Foreign Application Priority Data

Aug. 17, 1977 [JP] Japan ..... 52-98481

[51] Int. Cl.[2] ..... E06B 3/94

[52] U.S. Cl. ..... 160/84 H

[58] Field of Search ..... 160/84 H, 84 R, 84 V, 160/141, 144, 152

[56] References Cited

U.S. PATENT DOCUMENTS 3,279,528 10/1966 Gambon et al. ..... 160/279 X

FOREIGN PATENT DOCUMENTS 1708374 9/1969 Fed. Rep. of Germany ..... 160/84 H 1395586 3/1965 France ..... 160/84 H 6508988 1/1967 Netherlands ..... 160/84 R

*Primary Examiner*—Philip C. Kannan

*Attorney, Agent, or Firm*—Jay M. Cantor

[57] ABSTRACT

A folding or undrawing means for an accordion curtain which is pivotally connected to one of vertical frame members provided at the lateral ends of the curtain and comprises a spiral spring urged to pull another frame member in the direction to fold the curtain, a rotatable reel adapted to be urged by the spring and a tape wound around the reel and connected to said another frame member, thereby to facilitate undrawing operation of the curtain and keep the curtain in full undrawn or folded position.

2 Claims, 4 Drawing Figures

FOLDING OR UNDRAWING MEANS FOR ACCORDION CURTAIN

This invention relates to a folding or undrawing means for an accordion curtain, and more particularly to an improvement in a folding or undrawing means for an accordion curtain having contractile frameworks.

Accordion curtains of this type, which have been heretofore widely used at a doorway to replace a door or as a partition of a room, have some fatal drawback that when they are folded or undrawn to open the doorway or the partition, they are likely to expand to narrow the doorway etc., due to the expansion force of the contractile framework and/or the resiliency of cloths etc. which cover the framework. To eliminate the drawback of the conventional accordion curtains, there have been proposed various measures. These measures, however, have their own disadvantages. Some of them have defects in their mechanisms, some of them have difficulties in curtain drawing and/or undrawing operation, and others have economical disadvantages because of their complicated machanisms.

The present invention is made to overcome the drawbacks, defects or difficulties of the conventional accordion curtains as mentioned above and it is an object of the present invention to provide an accordion curtain having an improved folding or undrawing means which is capable of keeping the curtain in its fully opened position when the curtain is undrawn.

Essentially according to the present invention, there is provided, in an accordion curtain comprising vertical frame members and foldable or contractile frameworks pivotally connected at the ends thereof to the frame members, folding or undrawing means for the accordion curtain which essentially consists of a housing pivotally connected to one of said frame members and having a tape taking out opening; a spiral spring disposed in the housing and urged in the direction to pull another frame member to fold the curtain; a rotatable reel adapted to be urged by said spiral spring; and a tape wound around the reel and connected to said another frame member.

The invention will be better understood from the following description taken in connection with the accompanying drawings in which.

Figure 1:
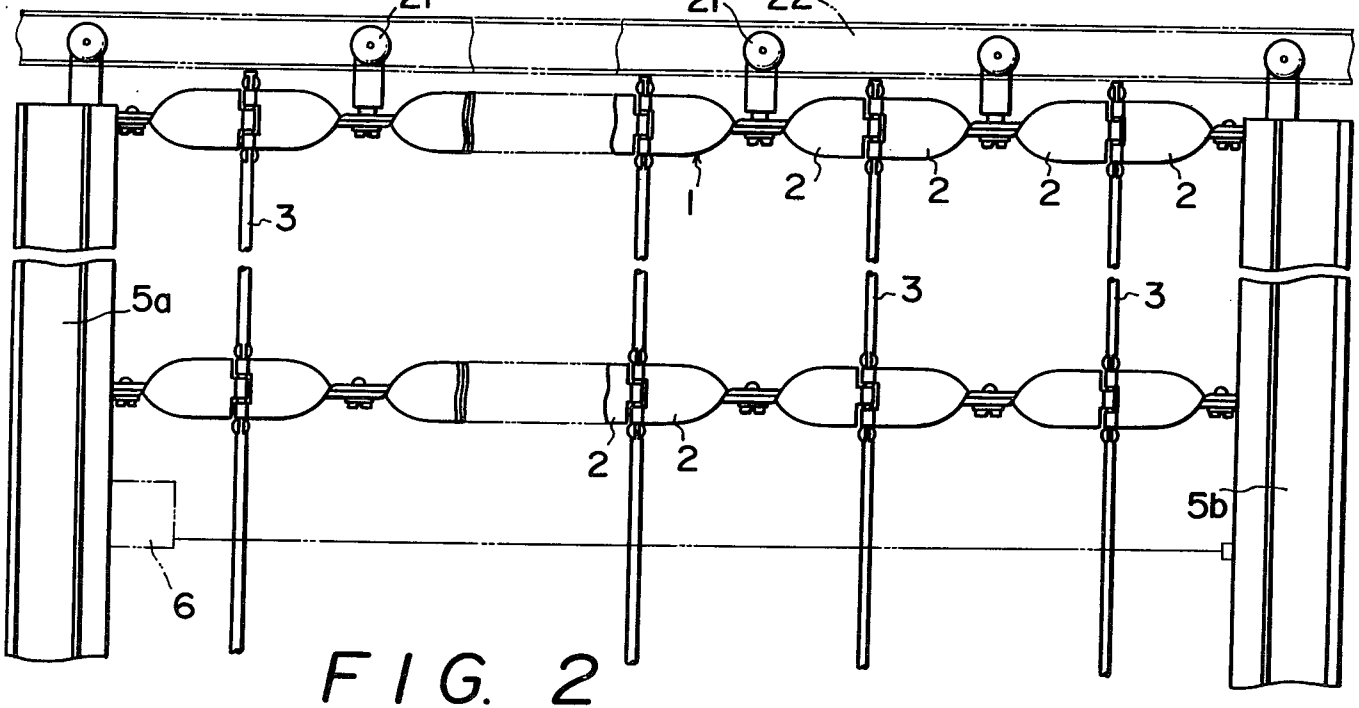
FIG. 1 is a partly cutaway elevational view of one form of the accordion curtain frameworks according to the present invention.
Figure 2:
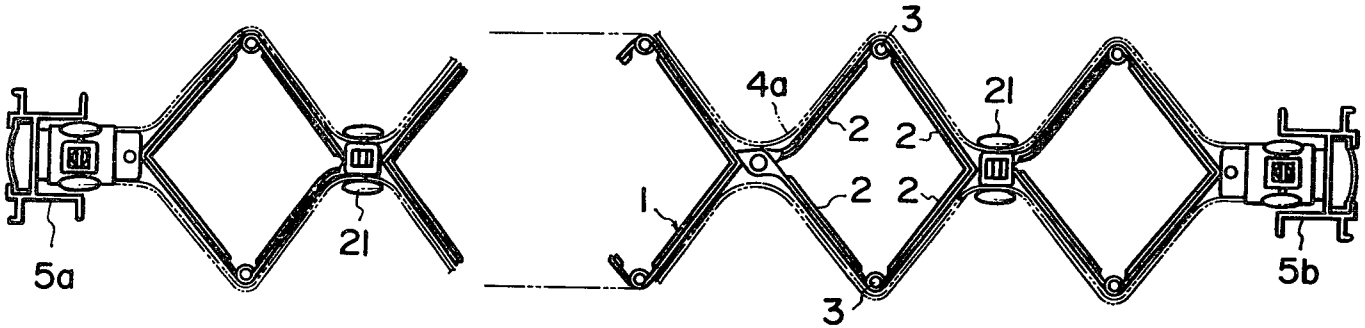
FIG. 2 is a plan view of the accordion curtain framework of FIG. 1.
Figure 3:
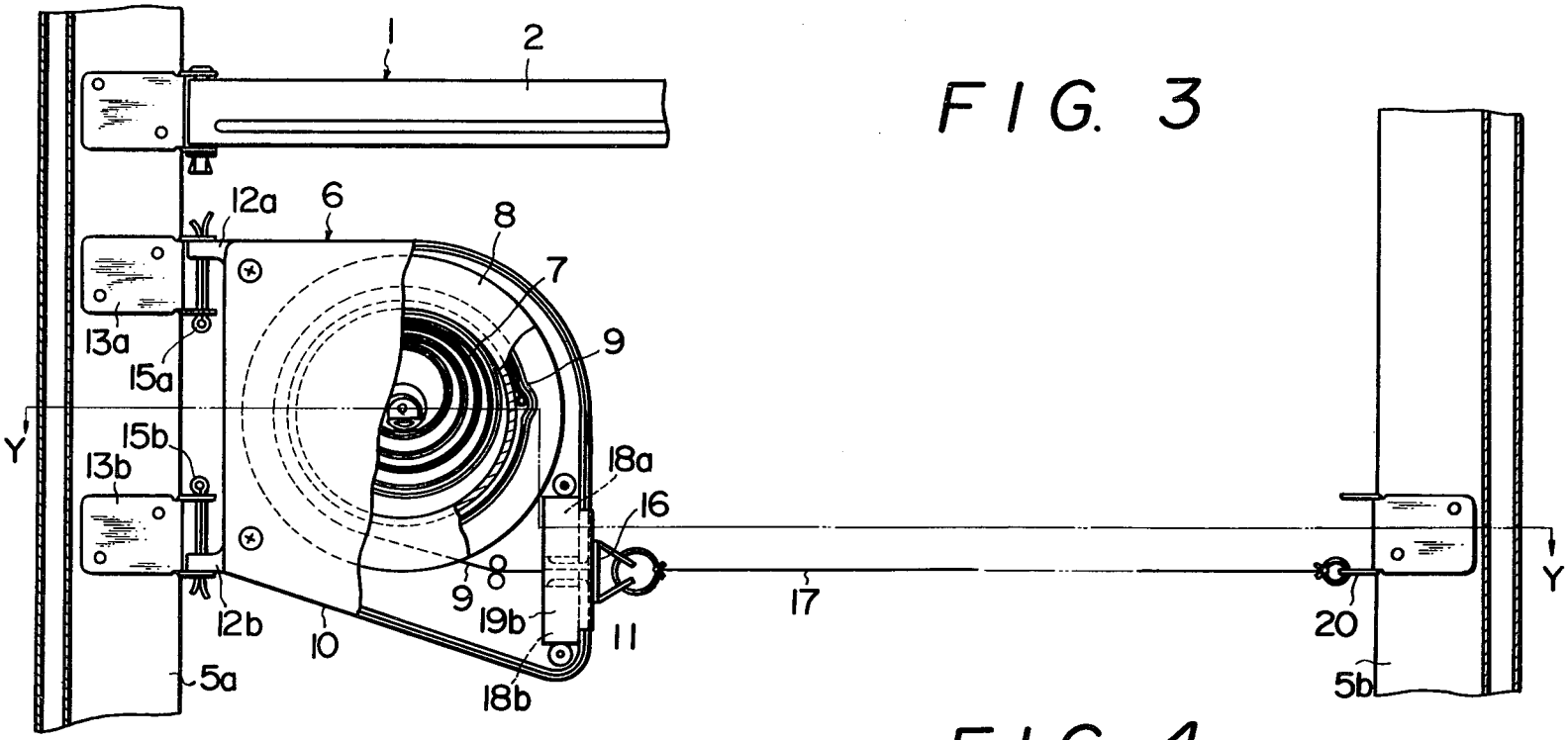
FIG. 3 is a partly cutaway elevational view of a curtain folding or undrawing means according to the present invention.
Figure 4:
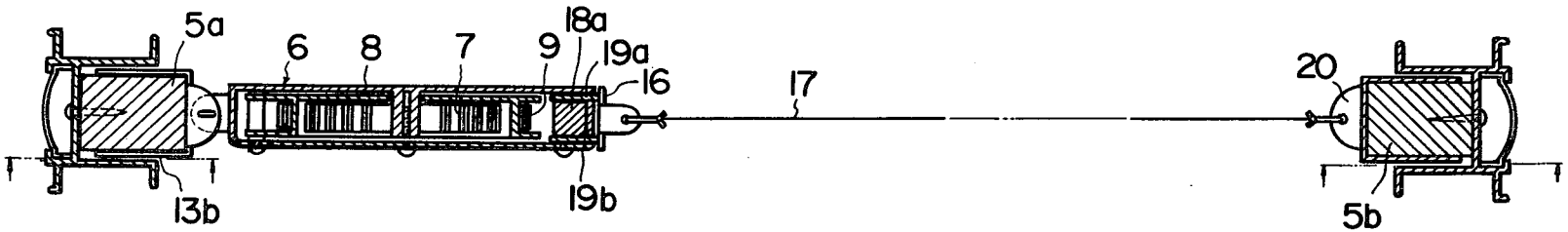
FIG. 4 is a cross sectional view taken along the line Y—Y of FIG. 3.

Referring now to the drawings, there is illustrated one embodiment of the present invention. A contractile framework 1 is formed of contractile members 2, each of which is composed of two parts pivotally connected to each other at their respective central portions, and vertical strut members 3 at their end portions, thereby to form a foldable structure along the width of the framework. The surfaces of the framework 1, namely, the front and the rear side of the framework, are covered with curtain covers 4*a*, 4*b* made of cloth, synthetic resin sheet, etc. The frameworks 1 are each connected at their end portions to frame members 5*a*, 5*b* to form a main body of an accordion curtain as shown in FIG. 1.

Curtain folding or undrawing means 6 is pivotally connected between the frameworks 1 to one of the frame members, namely, frame member 5*a* in this embodiment, so as to rotate crosswise in the drawing. The curtain folding or undrawing means 6 includes a housing 10 made of a suitable material such as a synthetic resin, wherein a spiral spring 7, a rotatable reel 8 adapted to be urged by the action of the spiral spring 7 and a tape 9 wound around the reel 8 are encased. The housing 10 has lugs 12*a*, 12*b* provided at its outward upper and lower end portions and a tape taking out opening 11 at its inner end portion. The housing 10 is connected to receivers 13*a*, 13*b* fixed to the frame member 5*a* through respective engagements of the lugs 12*a*, 12*b* of the housing 10 and lugs 14*a*, 14*b* formed on the receivers 13*a*, 13*b* with spring cotters 15*a*, 15*b*. The tip end of the tape 9 is fixed to a magnetic member 16 made of a magnetic material which is in turn connected to another frame member 5*b* through a wire 17. Magnets 18*a*, 18*b* for attracting the magnetic member 16 are fixed by adhesives at the tape taking out opening 11 and cores 19*a*, 19*b* are also fixed by adhesives, sandwiching said magnets 18*a*, 18*b* therebetween. Numeral 20 designates a receiver for the wire 17.

The thus constructed accordion curtain of the present invention is hung by runners 21 fixed to the upper end of the curtain and fitted in a rail 22 of a doorway etc. On the other hand, the frame member 5*a* is fixed by suitable means to one of the pillars of the doorway and another frame member 5*b* is disengageably fitted to another pillar of the doorway by means of a magnet 30 provided on the frame member 5*b* and a magnetic member 32 provided on said another pillar 34 of the doorway. The doorway is opened or closed by disengaging the frame member 5*b* from the pillar 34 or engaging it with the pillar 34. Stated illustratively, when the frame member 5*b* is manually pulled in the direction to fold the curtain in the state as shown in FIG. 1, the frame member 5*b* is disengaged from the pillar 34 and the tape 9 is automatically re-wound around the reel 8 and restored to its original position by a righting moment of the spiral spring 7, undrawing the curtain to open the doorway. In the thus folded state of the curtain, the magnetic member 16 is attracted to the cores 19*a*, 19*b* to keep the curtain in the state and keep the doorway in the fully opened state.

The velocity of undrawing the curtain and the force of pulling the curtain depend on the righting moment or restoring force of the spring 7 and they may be suitably adjusted by varying the strength and the number of turns of the spring depending on the length, width or weight of the main body of the curtain.

The attraction force between the magnetic material 16 and the cores 19*a*, 19*b* is suitably determined so as to be strong enough to keep the curtain in the fully folded state when the curtain is undrawn and to be weak enough to easily disengage the magnetic member 16 from the cores 19*a*, 19*b* when the frame member 5*b* is manually pulled in the direction to draw the curtain from the folded position.

The magnets 18*a*, 18*b* and cores 19*a*, 19*b* provided at the tape taking out opening 11 of the housing 10 may be replaced by members made of a magnetic material and the magnetic member 16 provided at the end of the tape 9 may be replaced by a magnet.

As mentioned above, the magnets 18*a*, 18*b* and cores 19*a*, 19*b* provided at the tape taking out opening 11 cooperate with the magnetic member 16 connected to the tape 9 which is always urged to be re-wound, to more surely keep the curtain in its fully folded position through the attraction between the magnets 18*a*, 18*b* and the cores 19*a*, 19*b* and the magnetic material 16 which is connected to the frame member 5*b* through the wire 17. At this fully folded position of the curtain, as the spiral spring 8 is not subjected to a force to expand the curtain, it is durable for a longer use. On the other hand, as the member 17 connecting the magnetic member 16 and the frame member 5*b* is subjected to the force to expand the curtain, it is advantageously made of a wire from a view point of its necessary tensile strength. The length of the wire 17 is determined by the overall width of the curtain in its fully folded position so as not to form a slack in the position.

The provision of the magnets 18*a*, 18*b* and cores 19*a*, 19*b* at the tape taking out opening 11 and the magnetic member 16 at the end of the tape may be omitted. In this case, a stronger spiral spring 7 is employed to attain the same effect of the present embodiment, though such an arrangement requires somehow stronger force to draw the curtain.

As mentioned above, the accordion curtain according to the present invention has a specific structure wherein the curtain folding or curtain undrawing means is incorporated in the main body of the curtain and composed of the housing fixed at its outer end portion to one of the two frame members and having an opening at its inner end portion for taking out the tape which is wound around the rotatable reel urged in the direction to be re-wound by the action of the spiral spring and is connected to another frame member, and advantageously has a further specific structure wherein magnetic means are provided on the housing at the tape taking out opening and on the tape to magnetically engage each other when the curtain is undrawn or folded to surely keep the curtain in the fully undrawn or folded position. Thus, the curtain is kept from expanding and maintained in the fully contracted position, allowing the doorway to be fully opened, essentially by the action of the restoring force of the spring and the linkage between the two frame members and more advantageously in cooperation with the magnetic means on the housing and tape. Further, the curtain folding or undrawing means of the present invention can solve difficulties in conventional means which employs a rod member as magnetic means for keeping a curtain in its folded or undrawn position. Stated illustratively, the present invention can eliminate such defects of the conventional means that the tip end of the rod member is liable to collide against a curtain framework, preventing the folding of the curtain and that the tip end of its magnetic rod is likely to pierce its curtain cloth, breaking it. Whereas, the present invention can ensure smooth opening or closing of the curtain and further has an economical advantage that it can provide such a curtain at a reasonable cost.

What is claimed is:

1. In an accordian curtain comprising vertical frame members and foldable or contractile frameworks pivotally connected at the ends thereof to the frame members, a folding or undrawing means for the accordion curtain which essentially consists of a housing pivotally connected to one of said frame members and having a tape taking out opening; a spiral spring disposed in the housing and urged in the direction to pull another frame member to fold the curtain, a rotatable reel adapted to be urged by said spiral spring; a tape wound around the reel and connected to said another frame member, said tape being connected to said another frame member through a wire and magnetic means provided at the tip end of the tape and at the tape taking out opening of the housing, respectively, for magnetically connecting each other in the folded position of the curtain to surely keep the curtain in the position.

2. Folding or undrawing means for an accordion curtain as set forth in claim 1, wherein said magnetic means provided at the tip end of the tape is a magnetic member and said magnetic means provided at the tape taking out opening is a magnet.

* * * * *